United States Patent [19]

Pavleszek

[11] 4,038,359

[45] Aug. 2, 1977

[54] METAL FORMING DIE

[75] Inventor: John Pavleszek, Colonia, N.J.

[73] Assignee: American Can Company, Greenwich, Conn.

[21] Appl. No.: 705,340

[22] Filed: July 14, 1976

[51] Int. Cl.[2] ..... B21D 22/00

[52] U.S. Cl. ..... 72/347; 72/467

[58] Field of Search ..... 72/347, 348, 349, 370, 72/467; 113/120 H

[56] References Cited

U.S. PATENT DOCUMENTS

| | | | |
|---|---|---|---|
| 2,412,813 | 12/1946 | Keller | 72/349 |
| 3,685,337 | 8/1972 | Avitzur | 72/347 |
| 3,765,206 | 10/1973 | Shah | 72/347 X |
| 3,893,326 | 7/1975 | Oberlander | 72/347 |
| 3,930,396 | 1/1976 | Martinez | 72/347 |

FOREIGN PATENT DOCUMENTS

| | | | |
|---|---|---|---|
| 1,954,365 | 5/1971 | Germany | 72/347 |

*Primary Examiner*—Leon Gilden

*Attorney, Agent, or Firm*—Robert P. Auber; Ira S. Dorman; George P. Ziehmer

[57] ABSTRACT

A metal forming die having a unique profile is provided for use in producing cylindrical articles of elongated sidewall configuration. Most notably, the die is applicable to the production of drawn and ironed can shells.

8 Claims, 3 Drawing Figures

FIG. 2
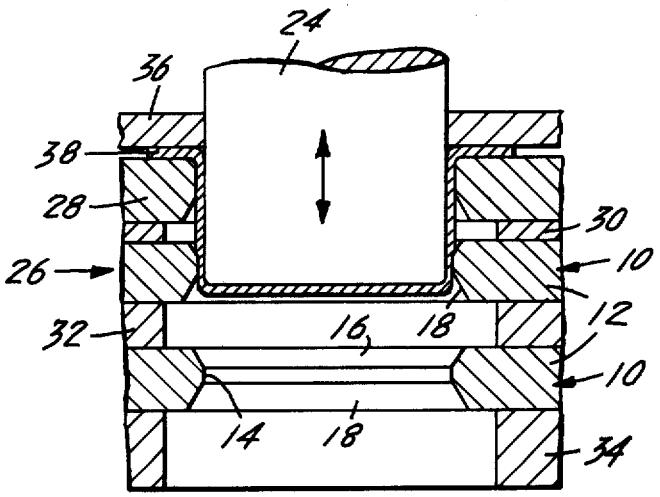
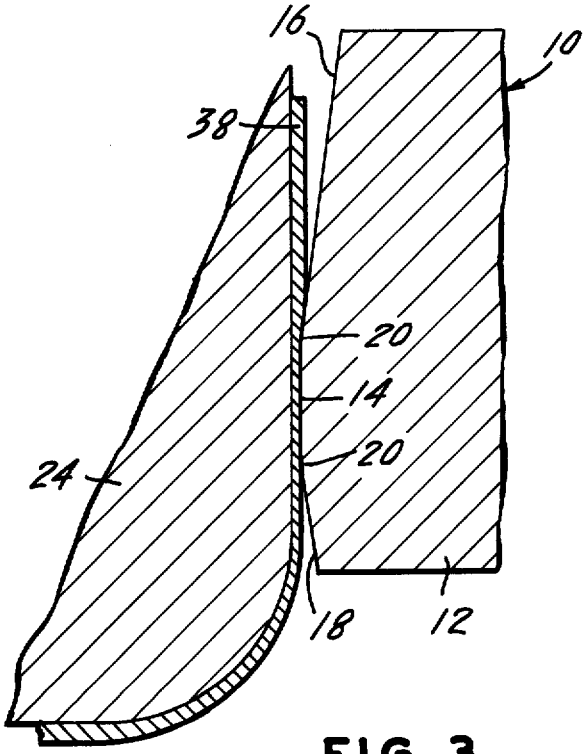
FIG. 3
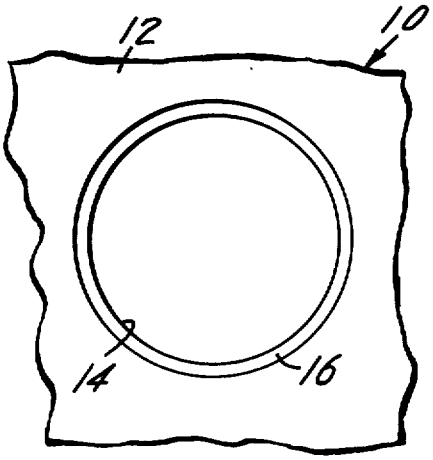
FIG. 1

METAL FORMING DIE

BACKGROUND OF THE INVENTION

It is now conventional to produce shells for two-piece cans by a drawing and ironing technique, such as in the manner described in U.S. Pat. No. 3,360,157. While the method and apparatus described in that patent, and elsewhere in the art, are entirely satisfactory under many circumstances, and indeed are in widespread use, in some instances certain deficiencies or difficulties are found to arise in practice.

More specifically, there has been found to be a lack of sufficient predictability and dependability in the ironing dies heretofore employed, making uniform production a very difficult matter. Moreover, the existing die configurations have tended to cause defects in the articles, sometimes destroying them and, in extreme cases, damaging the forming apparatus. Finally, such dies have not exhibited desirable levels of durability, and have required excessive maintenance to keep them in proper working condition. By-and-large, it is believed that the deficiencies and difficulties of the prior art dies are due essentially to the profile of the forming opening thereof.

Accordingly, it is an object of the present invention to provide a novel metal forming die, which affords predictable and dependable operation to produce articles of highly uniform configuration and dimensions, notwithstanding variations in the material of the blank from which the article is formed.

It is also an object of the invention to provide such a die which affords excellent control of the forming operations, to permit highly efficient manufacture while minimizing damage to the articles being produced, and to the forming apparatus.

It is still another object of the invention to provide a novel die having the foregoing features and advantages, which die is more durable and requires less maintenance than comparable dies heretofore provided.

SUMMARY OF THE INVENTION

It has now been found that the foregoing and related objects of the present invention are readily attained in a metal forming die adapted for coaction with a cylindrical punch, comprising a body having a highly uniform circular opening formed therein. The opening of the die is defined by a generally cylindrical land surface, an inwardly tapered frustoconical entrance surface leading to the land surface, an inwardly tapered exit surface extending from the land surface, and circular transition surfaces at the junctures of the entrance and exit surfaces with the land surface. In cross-section the entrance and land surfaces are rectilinear and the transition surfaces are curvilinear. The profile so defined affords smooth transition from the entrance surface to the land surface and from the land surface to the exit surface of the die.

In the preferred embodiments of the invention, the entrance surface of the die forms an angle of about 7° to 8° with the land surface thereof. The exit surface is also desirably of rectilinear cross-section, and forms an angle with the land surface of about 7° to 8°. Each transition surface may, in cross-section, have a radius of about 0.005 to 0.05 inch, and most desirably that dimension will be about 0.0015 to 0.0025 inch; preferably, the radius has its center on the axis between the two surfaces that it joins. The land surface of the die will be about 0.040 to 0.1 inch long, and it is desirably tapered toward the entrance side of the die. Generally, best results will be achieved if the land surface is relieved toward the exit side of the die by about 0.00002 to 0.00005 inch.

BRIEF DESCRIPTION OF THE DRAWINGS

FIG. 1 is a fragmentary top plan view of a metal forming die embodying the present invention;

FIG. 2 is a fragmentary, diagrammatical, cross-sectional view of a mechanism for drawing and ironing can shells, utilizing two metal forming dies embodying the invention; and FIG. 3 shows a right-hand section of the uppermost ironing die of the mechanism of FIG. 2, drawn to a greatly enlarged scale.

DETAILED DESCRIPTION OF THE ILLUSTRATED EMBODIMENT

Turning now in detail to the appended drawing, therein illustrated is a metal formind die, generally designated by the numeral 10, and comprising a body 12 having a circular opening formed therethrough. As best seen in FIG. 3, the opening is defined by a generally cylindrical land surface 14, an inwardly tapered frustoconical entrance surface 16, in inwardly tapered frustoconical exit surface 18, and circular transition surfaces 20 at the junctures of the frustoconical surfaces 16,18 with the land surface 14. As can be seen the frustoconical surfaces 16,18 and the land surface 14 are generally rectilinear in cross-section, and the transition surfaces 20 are of circular cross-section. The centers of the radii of the surfaces 20 are disposed on axes between the land surface 14 and the frustoconical surfaces 16,18, respectively.

Referring particularly to FIG. 2, the drawing and ironing mechanism includes a punch 24, driven axially (by means not shown), and a die stack assembly, generally designated by the numeral 26. The punch 24 and assembly 26 are axially aligned, and are so disposed that the punch may be driven through the die stack. The assembly 26 includes an upper drawing die and two ironing dies 10, which embody the invention. A spacer 30 is positioned between the dies 28 and 10, and a similar spacer 32 is disposed between the two ironing dies 10, to properly position the dies for sequential operation. The dies and spacers are supported upon a carrier 34, and a blank holder 36 is suitably mounted to receive a metal blank 38 and to maintain appropriate force thereon.

In operation, the metal blank 38 is positioned between the drawing die 28 and the blank holder 36 so that, as the punch 24 ia forced into the die stack 26, the blank 38 is formed into a cup by the drawing die 28. As the blank 38 is forced further inwardly by the punch 24, it enters the ironing dies 10, which successively elongate the cup and reduce its sidewall thickness. As will be appreciated, the inside diameter of the opening of the outer ironing die 10 is smaller than that of the inner one, so that such successive elongation and thickness reduction does occur, the operative portion of the dies for these purposes being essentially the land surfaces 14 thereof. Upon continuing inward movement, and after the blank is fully formed into the desired article, the latter is stripped from the punch 24 in a conventional manner. As will be appreciated the holder 36 applies sufficient gripping force to the blank 38 to ensure that the metal is plastically stretched as it is drawn across the face of the drawing die 28. In addition, it will be understood that suitable means will be provided to transport blanks and finished products to and from the foregoing mechanism.

It is important to note that the dies of the present invention must have a frustoconical entrance surface leading to the land surface thereof, the term "frustoconical" herein being used to define a surface which is, in cross-section, rectilinear. The provision of such a rectilinear leading surface ensures that compression of the metal of the blank will occur uniformly during ironing, in turn ensuring that the sidewall will be of uniform thickness throughout its length, and that efficient and reproducable results are achieved. Unavoidable variation of the metal within a particular blank, and from blank-to-blank, make a uniformly increasing compressive force especially significant to the production of satisfactory can shells and other articles therefrom. As has hereinbefore been noted optimal results are attained if the frustoconical entrance surface forms an angle of about 7° to 8° with the land surface. Broadly, however, that angle may range from about 5° to 10°, albeit with less satisfactory results from the standpoints of surface discontinuity and physical damage, if the angle is too small, and overheating and loss of control if it is too large.

The surface of the die extending from the land surface is also desirably of rectilinear cross-section, although that is not necessarily the case. However, it is essential that the exit surface taper inwardly, so that the expansion of the metal which necessarily occurs when the compressive forces of the forming operation are relieved, has an opportunity to occur. As is true of the entrance surface, when the exit surface is frustoconical an angle of about 7° to 8° with the land surface has been found to give most satisfactory results. In any event, forming such an exit surface with the same angle of taper as the entrance surface is most desirable.

The land surface of the die will be essentially cylindrical, so as to provide a radially innermost surface which is substantially parallel to the surface of the forming punch with which the die cooperates. However, it is desirable to form the land surface with a very slight taper in the direction of the entrance side of the die, again to avoid undully abrupt expansion of the metal. Thus, it has been found that a taper in which the radius at the outlet side od the land surface is about 0.00002 to 0.00005 inch greater than the radius at the inlet side will afford the gradual release of compression that is desired.

A most significant feature of the invention resides in the provision of the transition surface to and from the land surface of the die. Typically, dies of the type herein described and formed with frustoconical entrance and exit surfaces have been provided with sharp junctures between the rectilinear surfaces thereof. This was done at the entrance side of the die to provide a shear point (actually, a circular shear line), at the entrance of the land surface, since it was believed that the application of shear forces was necessary and desirable for efficient ironing. However, it has now been found, contrary to the foregoing belief, not only that such a manner of operation is unnecessary, but that, indeed, it is undesirable under certain circumstances. Thus, it is now appreciated that a curvilinear or radiused transition zone between a frustoconical entrance surface and a generally cylindrical land surface induces a rolling compressive force in the metal being formed, which in turn affords significant advantages.

More specifically, due to thermal expansion the shear point in a die of the sort described tends to drift, thus making uniformity and reproducability, from article to article, a very difficult objective to achieve; variations in sidewall thickness and length are, obviously, most undesirable. Moreover, due to limitations of die manufacture, it is virtually impossible to produce a second die havng exactly the same dimensions and configurations as a first. These factors have tended to limit reproducability, predictability and dependability in prior art dies.

Secondly, a shear-type action, as opposed to a rolling compression, exerts very high levels of tensile stress upon the metal being formed, tending to split, tear or otherwise severely damage the articles produced. This is particularly so when tinplate steel of low tin content is employed. Thus, ½ pound, or 0.50 electrolytic, tinplate provides, in most instances, sufficient surface tin so that direct contact of the underlying steel with the shear point of a die having that feature is avoided. However, when attempts are made to utilize quarter pound, or 0.25 electrolytic, tinplate in manufacturing operations, the surface coating of tin is found to be inadequate. Utilizing the die profile described herein enables the production of drawn and ironed can shells employing 0.25 electrolytic tinplate; it also makes production with unplated steel entirely feasible. The present dies may be used with metals other than steel and tinplate (notably aluminum), but with considerably less advantage.

The presence of a shear point, in addition, tends to cause poor metal distribution, and buildup of metal particles on the die, the latter being true at both the entrance and exit sides of the land surface. Metal buildup scores, scratches or otherwise contributes to poor appearance of the article; if the amount is sufficiently great, the deposit may, in fact, cause the destruction of the article itself. In any event, products of the instant dies will generally exhibit inner and outer surfaces which are of consistently good quality. Finally, the sharp shear points tend to wear excessively, thus requiring frequent polishing and grinding to renovate the die, or its replacement with undue frequency. Dies configured in accordance with the present invention require less frequent renovation and replacement.

It is to be noted that the manner in which the transition surfaces are produced is very important, since they must be circumferentially highly uniform. More specifically, they must be radially generated by rotation about the axis of the die or by equivalent means; they may not be developed longitudinally, such as by a forming member whose primary movement is axially through the die. Production in the latter manner would tend to produce circumferential non-uniformity, and could not be tolerated. It is also important that the radius of the transition surface be aligned on the axis between the surfaces that it joins, if entirely satisfactory operation is to be achieved. Moreover, while the term "curvilinear" has been used to describe the cross-sectional configuration of the transition surfaces, generally an arcuate or radiused surface will be necessary for optimum results.

Thus, it can be seen that the present invention provides a novel metal forming die which affords predictable and dependable operation, to produce articles of consistently uniform configuration and dimensions. The die affords excellent control of the forming operations to permit most efficient manufacture, while minimizing damage to the articles produced, and it is highly durable and demands less maintenance than dies heretofore provided.

Having thus described the invention, what is claimed is:

1. A metal forming die adapted for coaction with a cylindrical punch, comprising a body having a uniform circular opening therein, said opening being defined by a generally cylindrical land surface, an inwardly tapered frustoconical entrance surface leading to said land surface, an inwardly tapered exit surface extending from said land surface, and circular transition surfaces at the junctures of said entrance and exit surfaces with said land surface, in cross-section said entrance and land surfaces being rectilinear and said transition surfaces being arcuate, whereby smooth transition is afforded from said surface to said land surface and from said land surface to said exit surface.

2. The die of claim 1 wherein said entrance surface forms an angle of about 7° to 8° with said land surface.

3. The die of claim 2 wherein said exit surface is of rectilinear cross-section, and forms an angle of about 7° to 8° with said land surface.

4. The die of claim 1 wherein each of said transition surfaces has, in cross-section, a radius of about 0.005 to 0.050 inch.

5. The die of claim 4 wherein said radius is about 0.0015 to 0.0025 inch.

6. The die of claim 5 wherein the center of said radius between said land and entrance surfaces lies on the axis therebetween.

7. The die of claim 1 wherein said land surface is about 0.040 to 0.10 inch and tapers slightly toward the entrance side of said die.

8. The die of claim 7 wherein said land surface is relieved toward the exit side of said die by about 0.00002 to 0.00005 inch.

* * * * *